United States Patent [19]

Funahashi et al.

[11] 4,286,399

[45] Sep. 1, 1981

[54] CARD OR BOOK INVOLVING LUMINESCENCE

[75] Inventors: Masao Funahashi; Shigeru Maeda, both of Hirakata, Japan

[73] Assignees: Matsushita Electric Industrial Co., Ltd.; Kyokuto Electric Co., Ltd., both of Osaka, Japan

[21] Appl. No.: 131,802

[22] Filed: Mar. 19, 1980

[30] Foreign Application Priority Data

Jul. 25, 1979 [JP] Japan ..... 54-102784[U]
Jul. 25, 1979 [JP] Japan ..... 54-102785[U]

[51] Int. Cl.[3] ..... G09F 1/00

[52] U.S. Cl. ..... 40/124.1; 40/442; 40/152.2

[58] Field of Search ..... 40/124.1, 152.1, 442, 40/152.2

[56] References Cited

U.S. PATENT DOCUMENTS

| | | | |
|---|---|---|---|
| 2,826,844 | 3/1958 | Leika | 40/152.1 |
| 3,289,342 | 12/1966 | Gibson | 40/152.2 |
| 4,055,014 | 10/1977 | Schmidt | 40/442 |

*Primary Examiner*—Gene Mancene
*Assistant Examiner*—Wenceslao J. Contreras
*Attorney, Agent, or Firm*—Joseph W. Farley

[57] ABSTRACT

At least one of two openable leaves is provided with at least one light-emitting diode, a thin battery for lighting the diode and a switch assembly. On opening the leaves, the diode emits light, which is extinguished when the leaves are closed to provide an indication of unique interest.

5 Claims, 6 Drawing Figures

CARD OR BOOK INVOLVING LUMINESCENCE

This invention relates to Christmas cards, birthday cards, menu cards, programs, books or the like (hereinafter referred to briefly as "cards") which are provided with light-emitting diodes and a thin battery for giving an indication of interesting taste by causing the diodes to emit light through a switch assembly.

These cards usually bear printed letters, pictures, devices, etc., which nevertheless are in a very ordinary type and are of little appeal to the eye.

The main object of the present invention is to provide cards of peculiar interest having incorporated therein a thin battery developed in recent years and light-emitting diodes adapted to be turned on or off by opening or closing the card.

Another object of the invention is to provide cards of the type described which have incorporated therein a circuit for automatically switching the light-emitting diodes.

Still another object of the invention is to provide cards of the foregoing type including two leaves and a switch assembly for turning on and off the above-mentioned light-emitting diodes, the switch assembly comprising a pair of electrodes for the thin battery incorporated in one of the leaves and a slide plate having one end attached to the other leaf and the other end provided with a conductor piece for bringing the pair of electrodes into conduction.

Other features and advantages of the invention will become apparent from the following description of a preferred embodiment given with reference to the accompanying drawings, in which.

Figure 1:
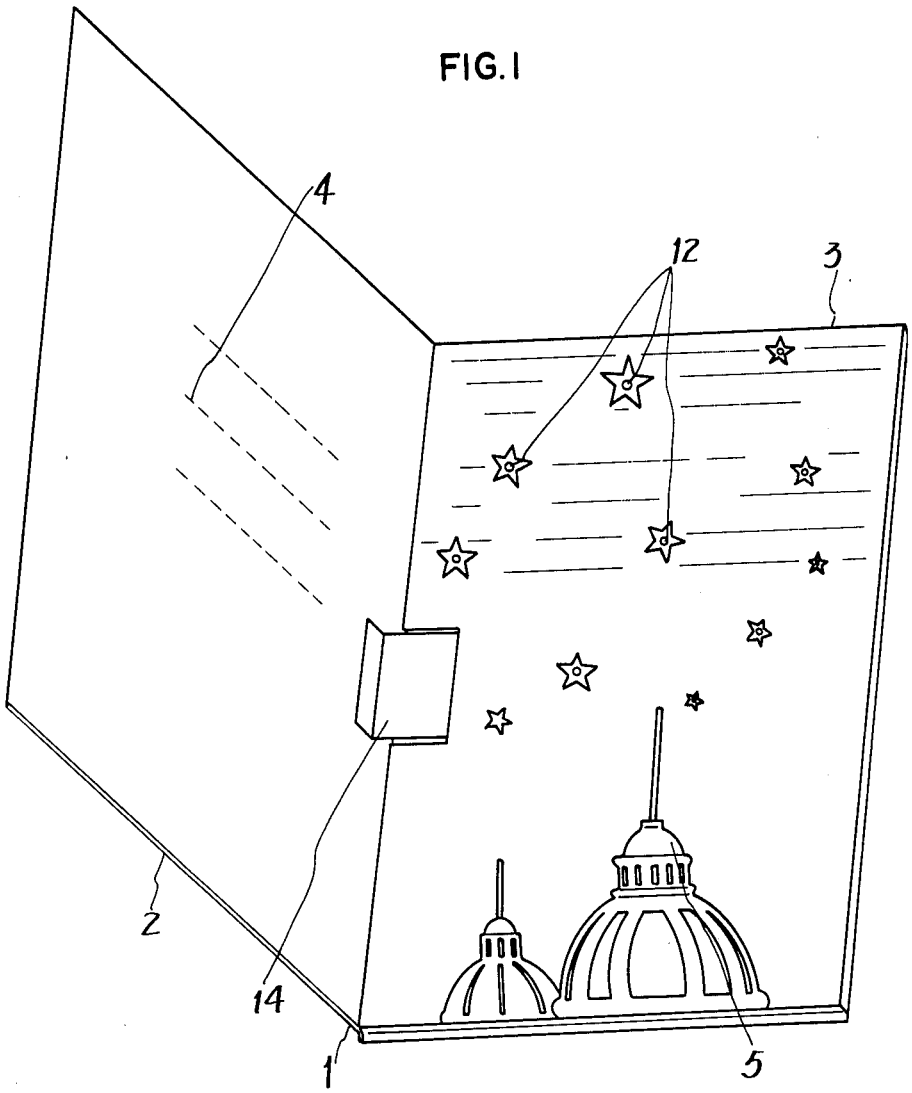
FIG. 1 is a perspective view showing a card embodying the invention and involving luminescence.
Figure 2:
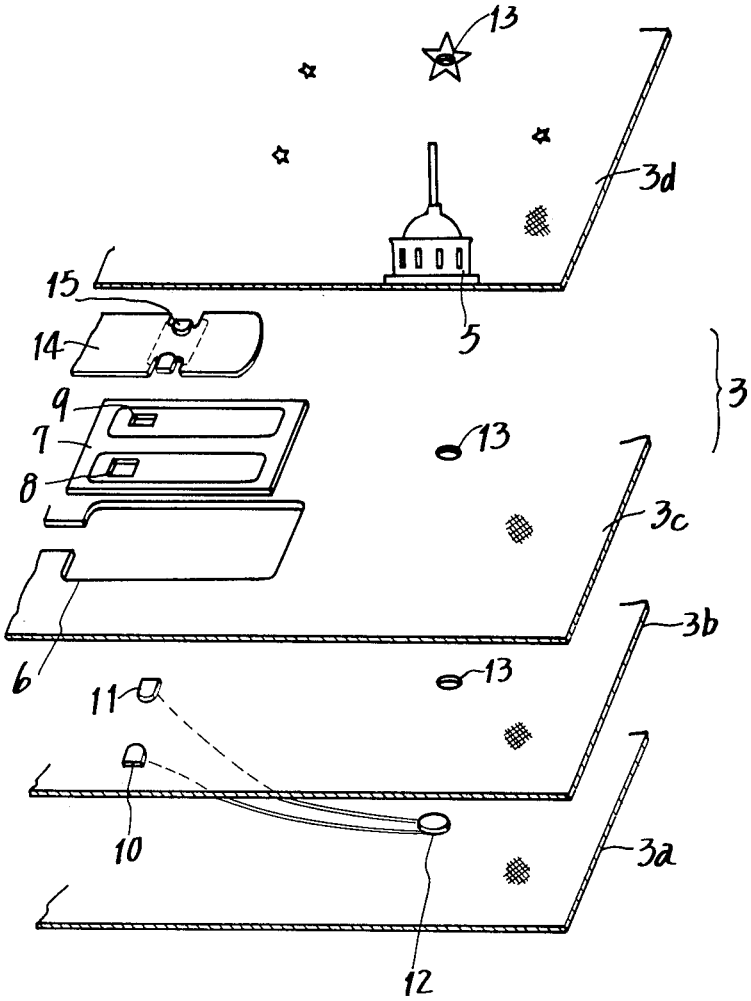
FIG. 2 is an exploded perspective view showing the same.
Figure 3:
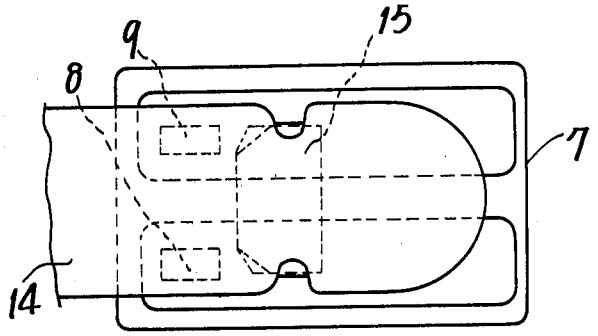
FIGS. 3 and 4 are views illustrating a switch assembly.
Figure 4:
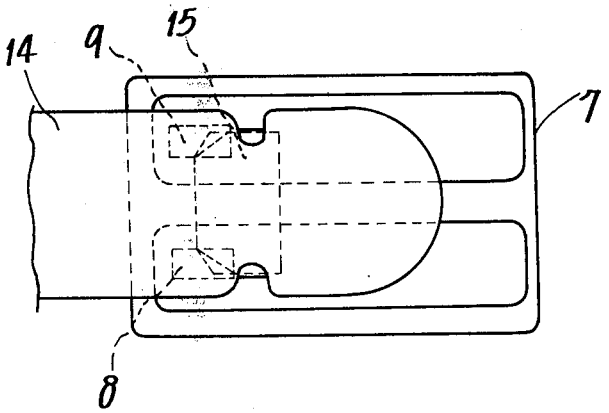

With reference to FIGS. 1 to 4, a foldable Christmas card 1 includes leaves 2 and 3 bearing letters 4 and a picture 5 printed on the inner side thereof as desired. The leaf 3 bearing the picture 5 comprises at least four laminated paper sheets 3*a*, 3*b*, 3*c* and 3*d*. The third sheet 3*c* is formed with a cutout 6 for fixedly accommodating a thin battery 7 which is a so-called paper battery and about 2 mm in thickness.

The thin battery 7 comprises a set of two battery units housed in a thin film case having electrically insulating properties and provided with exposed positive and negative electrodes 8 and 9 on one side thereof. The sheet 3*b* beneath the thin battery 7 has terminal pieces 10 and 11 in contact with exposed positive and negative electrodes (not shown) on the lower side of the battery 7. The terminal pieces 10 and 11 are connected to a plurality of light-emitting diodes 12. The light-emitting portion of the diode 12 is fitted in apertures 13 formed in the second, third and fourth sheets 3*b*, 3*c* and 3*d*, exposed to outside on the surface of the fourth sheet 3*d* and associated with the picture 5, for example, with a star printed on the fourth sheet 3*d*.

The card is provided with a switch assembly of the slide-on type comprising a thin insulator plate (hereinafter referred to as "slide plate ") 14 having one end attached to the inner side of the other leaf 2 and the other end in the form of a free end, and a conductor piece 15 mounted on the slide plate 14. The free end of the slide plate 14 is interposed between the third and fourth sheets 3*c* and 3*d* to position the conductor piece 15 in facing relation to the electrodes 8 and 9 of the battery 7. Thus the conductor piece 15 is slidable by the leaves 2 and 3 when they are opened or closed. Stated more specifically the conductor piece 15 electrically connects the electrodes 8 and 9 of the battery 7 only while the leaves 2 and 3 are in their opened position to establish a circuit for causing the diodes 12 to emit light.

Figure 5:
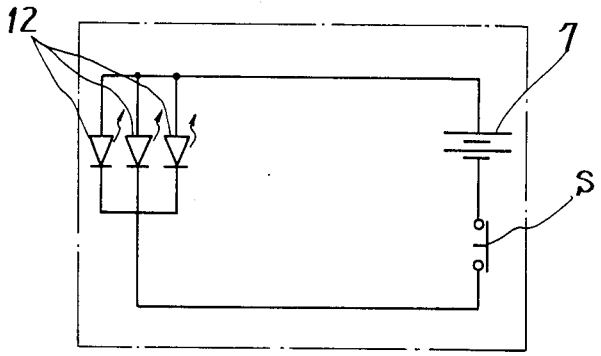
FIG. 5 is a diagram showing an electric circuit included in the card.
Figure 6:
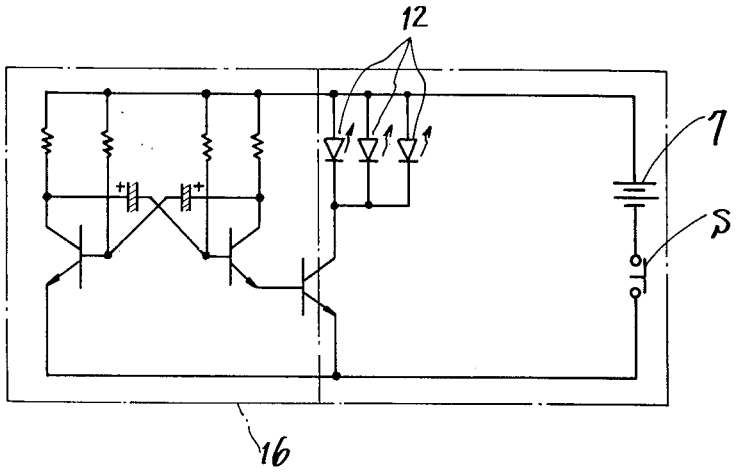
FIG. 6 is a diagram showing a modification of the circuit.

FIG. 5 shows a basic circuit, including a switch S, for the light-emitting diodes 12. FIG. 6 shows an automatic switching circuit 16 comprising a flip-flop circuit. With use of this circuit, light is emitted by the diodes 12 and extinguished repeatedly in automatic cycles.

The card of this invention thus emits light with the foregoing construction. When the card is opened, the leaf 2 pulls the slide plate 14 and shifts the conductor piece 15 from the position of FIG. 3 to the position of FIG. 4, thereby connecting the electrodes 8 and 9 of the battery 7 to cause the diodes 12 to emit light. When the card is closed, the slide plate 14 is forced into the leaf 3 to the position shown in FIG. 3, consequently moving the conductor piece 15 away from the electrodes 8 and 9 of the battery 7 to bring the electrodes 8 and 9 out of conduction and de-energize the diodes 12.

The cards or books of this invention involving emission of light have various advantages as will be stated below.

(1) The diode, which is caused to emit light as associated with a picture, pattern or the like on the card, affords an indication of interesting taste.

(2) The light-emitting diode used as a luminescent element is serviceable with safety free of any break or like failure of any hazard and therefore has a long life.

(3) Since the card has incorporated therein a thin battery in combination with light-emitting diodes, the card itself is as thin as conventional cards in its entirety.

(4) Use of an automatic electronic circuit for repeatedly turning on and off the diode creates an increased interest.

(5) Since the diode is controllable for the emission or extinction of light by opening or closing the card, the card is easy to handle and will not entail useless consumption of power when held closed.

(6) Because the switch assembly comprises a slide plate and a conductor piece and utilizes the electrodes of a thin battery, the assembly is thin and advantageous to incorporate into cards of the type described without necessitating an additional member such as an operating member.

Needless to say, the present invention is not limited to cards but is similarly useful for books, etc.

What is claimed is:

1. A card or book involving luminescence and comprising:

at least two openable leaves;

a thin battery provided in one of the leaves and having on one side thereof electrodes to be brought into conduction with each other;

at least one light-emitting diode lit by the battery and having its light-emitting portion exposed to outside on an inner surface of said one leaf;

a switch assembly comprising a slide plate which has one end attached to the inner surface of the other leaf and a free end provided with a conductor piece, the free end being superposed slidably on the electrode bearing side of the battery in said one leaf and the conductor piece being engageable with the battery electrodes in response to opening movement of the two leaves.

2. A card or book as defined in claim 1 wherein the diode is provided with a lighting circuit incorporating therein an automatic switching circuit comprising a flip-flop circuit.

3. A card or book as defined in claim 1 or 2 wherein said one leaf is composed of a plurality of laminated sheets comprising a front sheet, a back sheet and at least one intermediate sheet, a cutout formed in the intermediate sheet for accomodating the battery, and the switch assembly slide plate is slidably positioned between the battery and one of the front and back sheets.

4. A card or book as defined in claim 1 or 2 wherein said one leaf is composed of a plurality of laminated sheets comprising a front sheet, a back sheet and two intermediate sheets, a cutout formed in one of the intermediate sheets for accomodating the battery, contact elements mounted on the other intermediate sheet for engagement with electrodes on one side of the battery, said contact elements being electrically connected to the light-emitting diode, and the switch assembly slide plate is slidably positioned between the other side of the battery and one of the front and back sheets.

5. A card or book as defined in claim 4 wherein the light-emitting diode is mounted within apertures formed in the front and intermediate sheets, said one intermediate sheet is adjacent to the front sheet, and said other intermediate sheet is adjacent to the back sheet.

* * * * *